United States Patent [19]

Li

[11] Patent Number: 4,852,887

[45] Date of Patent: Aug. 1, 1989

[54] METHOD OF PLAYING A THREE IN A ROW GAME

[76] Inventor: Jian X. Li, 139 Princeton Ave., #1, Amherst, N.Y. 14226

[21] Appl. No.: 206,361

[22] Filed: Jun. 14, 1988

[51] Int. Cl.[4] ..... A63F 3/02

[52] U.S. Cl. ..... 273/264

[58] Field of Search ..... 273/264, 271

[56] References Cited

U.S. PATENT DOCUMENTS

| | | | |
|---|---|---|---|
| 1,262,312 | 4/1918 | Dewante | 273/264 |
| 1,529,132 | 3/1925 | Jimison | 273/264 |
| 4,136,882 | 1/1979 | Odza et al. | 273/264 |

FOREIGN PATENT DOCUMENTS

| | | | |
|---|---|---|---|
| 24286 | 11/1900 | United Kingdom | 273/264 |

*Primary Examiner*—Edward M. Coven

*Assistant Examiner*—Benjamin Layno

*Attorney, Agent, or Firm*—Richard C. Litman

[57] ABSTRACT

With a special game board design in a game that requires filling the intersections of the design by players taking alternate turns at placing markers at the intersections one at a time. In this process each player tries to achieve three of his markers in a row, whereupon he may remove one of his opponent's markers from the board. Play continues until all of the intersections are filled. Some intersections may be vacated by removing surrounded markers after which each player moves his markers one space into vacated intersections. Again, each player tries to get three in a row. Any of the following three events ends the game; namely, there are no surrounded markers and all the intersections are covered with markers so that the loser cannot fulfull his turn; all of the loser's markers are surrounded; all of a loser's markers are removed from the board.

1 Claim, 2 Drawing Sheets

METHOD OF PLAYING A THREE IN A ROW GAME

SUMMARY OF THE INVENTION

A special game board design is used by players who in alternate turns fill the board at intersections of the designs with markers. One marker per turn is placed on an empty intersection. Each player tries to make the situation where three of his markers are placed in a row and then removes one of his opponent's markers from the board. Play proceeds until all of the intersections are filled. When this occurs all surrounded markers, "dead" markers, are removed from the board. Then play continues in a different vane. Each player in turn moves his markers one space to the different vacant intersections in an attempt to form three in a row and then remove an opponent's markers from the board.

Any one of three conditions may end the game; when and if there are no surrounded markers when all of the intersections are covered with markers so that a loser cannot fulfill his turn, when and if one winning player's markers surround all of his opponent's markers so that a losing player's markers cannot be moved, and when and if all of a losing player's markers are removed from the board.

It is an object of this game to present a new unique game board.

It is a further object to produce rules for filling the intersections of the game board design with markers.

It is a further object to present rules for surrounding opponent's markers and when all the intersections are filled to vacate by removal those markers that are surrounded.

It is further object for attempting by the players to gain three markers in a row whereupon one mark of opponent is removed from the board.

It is a further object to present rules for winning and loosing at the termination of the game.

BACKGROUND

U.S. Pat. No. 4,555,116 issued to F. H. Fields is drawn to a game that uses a game board for playing modified version of the ancient board game, GO. The board contains a rectangular arrangement of equidimensional, contiguous hexagons.

U.S. Pat. No. 4,200,298 issued to S. Lamlee discloses a board game in which tokens are placed on the enclosed areas of a board. When a player places a token adjacent to an area which is occupied by the token of the opponent, he removes the token. The first player to have only one token left on the game board wins the game.

U.S. Pat. No. 2,585,268 issued to P. Olsen discloses a board game which combines many aspects of chess and checkers. The game is player by up to four players and allows for players to "jump" over adjacent tokens of the opponents as is done in checkers.

U.S. Pat. No. 4,411,433 issued to W. M. Flynn is drawn to a board game wherein opposing players seek to place their game pieces adjacent to the "vulnerable" side, or sides, of the opponent's piece, whereupon the opponents piece may be removed. To win the game, a player's token must be placed in a specified position on the game board.

U.S. Pat. No. 942,984 issued to R. D. Underhill is drawn to a variation of traditional Chinese checkers.

U.S. Pat. No. 4,324,406 issued to J. D. Ocampo discloses a board game in which two types of game pieces are utilized: number "one" pieces which move like chess "bishops" and number "zero" which move like chess "rooks." The object of the game is to position one's game pieces in such a way that they form binary numbers.

U.S. Pat. No. 4,142,728 issued to A. P. Balduman is drawn to an apparatus for playing the game of "Mancala" which is popular in Africa and southern Asia. The apparatus includes three boards of hollowed-out depressions. The object of the game is to accumulate game tokens and at the same time capture the game tokens of one's opponent.

DETAILED DESCRIPTION

Figure 1:
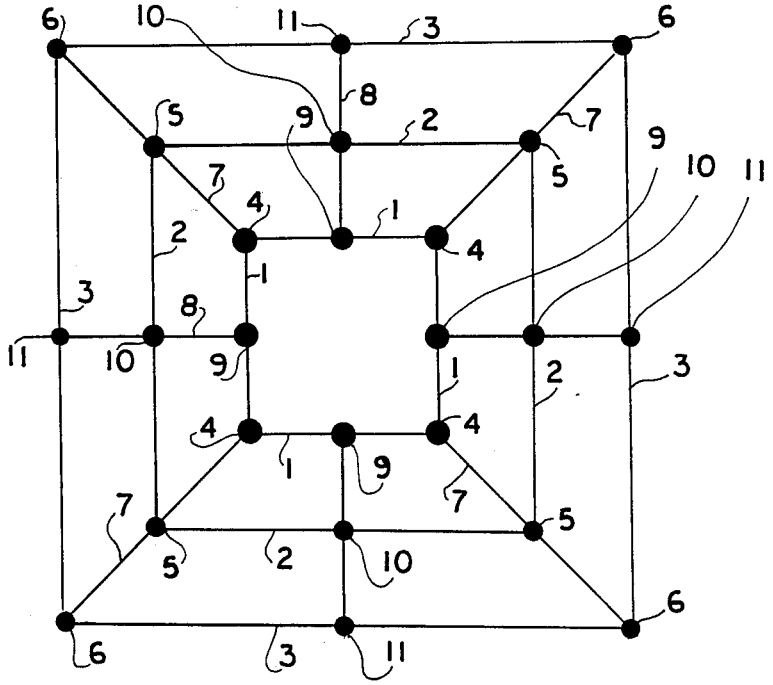
FIG. 1 is drawn to the design on the game board.
Figure 6:
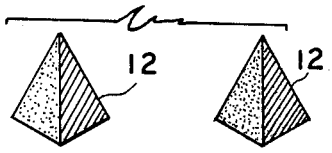
FIG. 6 is drawn to two markers.

The game is played on a game board with a design on it. The design comprises three different sized concentric squares from a smallest square 1,1,1,1 to a largest square 3,3,3,3 with the other square 2,2,2,2 having a side 2 twice a length of a side 1 of the smallest square 1,1,1,1. The largest square 3,3,3,3 has a side 3 three times the length of a side 1 of the smallest square 1,1,1,1. Each vertex 4 of the smallest square 1,1,1,1 and each vertex 6 of the largest square 3,3,3,3 interconnects by the shortest straight lines 7 intersecting each vertex 5 of the square having twice the length of the smallest square 1,1,1,1. The shortest straight lines 8 interconnect each center 9 of each side 1 of the smallest square 1,1,1,1 and each center 11 of the largest square 3,3,3,3 and also intersects each center 10 of each side of the square 2,2,2,2 having the side twice the length of the side 1 of the smallest square 1,1,1,1. Markers 12 in Figure 6 are provided for occupying each vertex 4,5,6 and each center 9,10,11 intersection of the design.

METHOD OF PLAY

Figure 2:
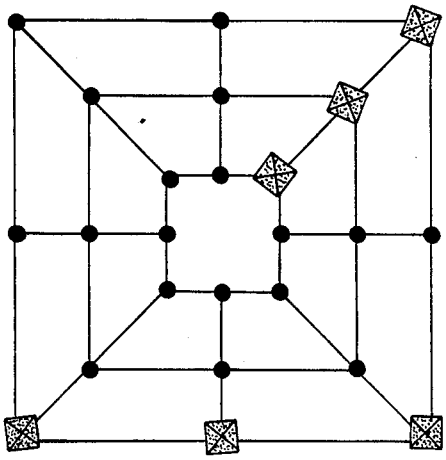
FIG. 2 is drawn to the object of the various plays of the game.

The first part of the game functions to cover all of the vertices and intersections of the game board with markers. Each of two players in turn puts one marker on the board every time his turn alternately comes to be played. If one player achieves getting three markers in a row in one straight line as in Figure 2, he may select one of his opponents markers to take off the board. When this happens the player achieving the three in a row says "three" to let his opponent know what has been accomplished by the player.

Figure 5:
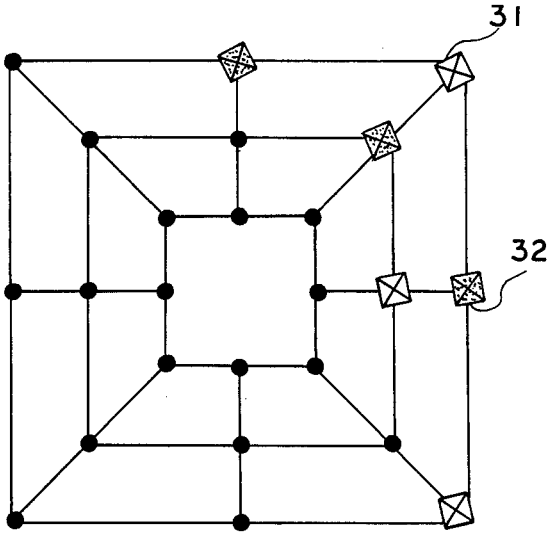
FIG. 5 shows an instance where both components have markers to be removed because of being surrounded.
Figure 3:
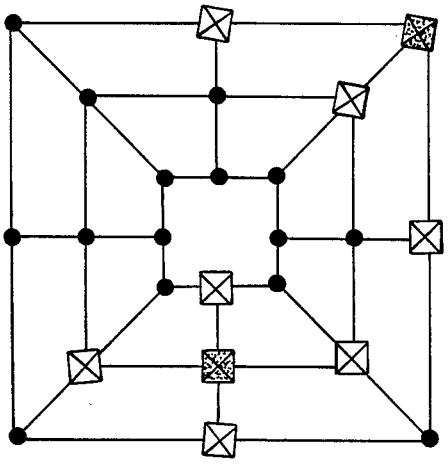
FIG. 3 shows how to surround and render "dead" a marker.
Figure 4:
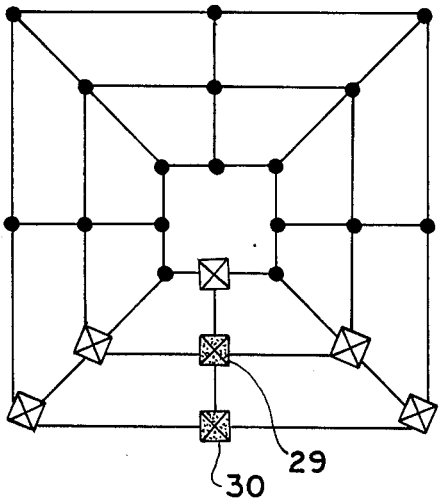
FIG. 4 shows an instance where the dark markers do not fulfill the rules of being surrounded.

When all of the vertices and intersections are filled by markers the first stage of the game is over. Before the second stage of the game begins, all the "dead" markers surrounded in straight line paths by opponent markers on adjacent intersections as in FIG. 3 and FIG. 5 are removed from the game board. In FIG. 5 markers 31 and 32 should be removed. FIG. 4 shows an instance where, by the rules, the dark markers 29 and 30 are not considered surrounded and as such should remain on the board.

After removal of the surrounded markers the game proceeds by players alternately moving their markers from one intersection to another adjacent intersection on the same straight line into the vacant spaces with the object of attaining three of each player's surrounding markers in a row. Each time this is achieved the player with three in a row selects one of his opponent's markers for removal from the board design.

There are three winning situations; namely, when and if there are no surrounding markers and all the intersections are covered with markers so that a loser cannot fulfill his turn; when and if one player's markers surround all of his opponents markers so that a loser cannot move; when and if all of a loser's markers are removed from the board.

I claim:

1. A method of playing a game comprising:

selecting two players to exercise alternate turns in playing;

providing a game board having a design with lines having intersections, some intersections being vertices of squares;

providing markers of two different identifying means for showing possession by each player;

placing a marker on one of said intersections by each player when his turn comes;

proceeding said alternate turns until one player attains for his markers a three in a row situation on one straight line of said design;

said one player removing one of his opponent's marker from the game board;

continuing play until all of the intersections are covered;

removing from the board all of the markers that are surrounded by the opponent's markers at adjacent intersections that are connected by straight lines containing the intersection on which the surrounded marker is situated;

proceeding by moving a marker from one intersection to an adjacent intersection on the same straight line for each turn of each player in an effort to make the three in a row situation;

removing one of the opponent's markers when a player attains this situation;

whereby a game ending occurrence happens when any one of the three occurrences transpires; namely, when and if there are no surrounded markers and all of the intersections are covered with markers so that a loser cannot fulfill his turn, when and if one winning player's markers surround all his opponent's markers so that a losing player's markers cannot be removed; when and if all a losing player's markers are removed from the board.

* * * * *